US005932858A

United States Patent [19]

Meinherz

[11] Patent Number: 5,932,858

[45] Date of Patent: Aug. 3, 1999

[54] STORED-ENERGY MECHANISM FOR A HIGH-VOLTAGE CIRCUIT-BREAKER POLE FILLED WITH AN INSULATING GAS

[75] Inventor: Manfred Meinherz, Berlin, Germany

[73] Assignee: Siemens Aktiengesellschaft, Munich, Germany

[21] Appl. No.: 08/894,770

[22] PCT Filed: Feb. 28, 1996

[86] PCT No.: PCT/DE96/00406

§ 371 Date: Jan. 9, 1998

§ 102(e) Date: Jan. 9, 1998

[87] PCT Pub. No.: WO96/27204

PCT Pub. Date: Sep. 6, 1996

[30] Foreign Application Priority Data

Mar. 1, 1995 [DE] Germany ..... 195 08 770

[51] Int. Cl.[6] ..... H01H 33/04; H01H 9/30

[52] U.S. Cl. ..... 218/84; 218/154

[58] Field of Search ..... 218/43, 44, 58, 218/71, 78, 84, 92, 118, 119, 120, 134, 140, 152, 153, 154, 155

[56] References Cited

U.S. PATENT DOCUMENTS 3,857,006 12/1974 Daimon et al. .
4,612,428 9/1986 Nicoloso ..... 218/155
4,654,494 3/1987 Wuethrich ..... 200/337
5,512,724 4/1996 Binder et al. ..... 218/140

FOREIGN PATENT DOCUMENTS

0463491 A2 1/1992 European Pat. Off. .
8705155.9 8/1988 Germany .

OTHER PUBLICATIONS

"SF6–Leistungsschalter für Bahnstromnetze der Deutschen Bundesbahn und der Schweizerischen Bundesbahn", Elektrische Bahnen, Sep., 1989*.

*Primary Examiner*—Lincoln Donovan
*Attorney, Agent, or Firm*—Kenyon & Kenyon

[57] ABSTRACT

A stored-energy mechanism for a high-voltage circuit-breaker pole filled with an insulating gas with a drive rod, which transmits the drive movement to an interrupter unit by thrust or traction and which can be driven through a drive crank attached to a drive shaft, and with an opening spring coupled to an opening crank attached to the drive shaft and with a closing spring driving a closing crank attached to the drive shaft. It is provided that the closing crank and the opening crank are arranged outside the insulating gas chamber. The drive crank is arranged inside the insulating gas chamber, a carrier block seals the chamber filled with insulating gas against the outer chamber, the drive shaft traverses a housing wall of the carries block in a gas-tight manner, and the carrier block forms an end support for the closing spring and the opening spring.

8 Claims, 2 Drawing Sheets

STORED-ENERGY MECHANISM FOR A HIGH-VOLTAGE CIRCUIT-BREAKER POLE FILLED WITH AN INSULATING GAS

FIELD OF THE INVENTION

The present invention relates to stored-energy mechanisms for high-voltage circuit-breakers filled with insulating gas.

BACKGROUND INFORMATION

In a stored-energy mechanism described in the brochure "$SF_6$ Outdoor Circuit Breakers from 72.5 to 420 kV" of the Sprecher & Schuh company, which can be used both for individual circuit-breaker poles and for three-pole circuit breakers, the drive shaft is arranged outside the insulating gas chamber in a separate drive housing, which also contains the closing spring and the corresponding drive elements. A knuckle joint system with corresponding traction rods is provided for coupling the drive shaft to the circuit breaker, with the shaft of the knuckle joint traversing the wall of the carrier block in a gas-tight manner.

SUMMARY OF THE INVENTION

An object of the present invention is to provide a stored-energy mechanism that is of a simple design, cost-effective, and compact.

The present invention provides a stored-energy mechanism for a high-voltage circuit-breaker pole filled with an insulating gas with a drive rod that transmits a drive movement to an interrupter unit by thrust or traction and is coupled for this purpose to a drive shaft actuated by both a closing spring and an opening spring, and is to be used in the constructive design of stored-energy mechanisms comprising a plurality of drive elements wherein the closing spring is coupled to a closing shaft and the closing shaft actuates the drive shaft via a cam plate and a closing crank actuates the drive shaft. A housing-type carrier block seals the isolating gas chamber from the outer chamber, the carrier block forming the end support for the opening spring. A drive element traverses a housing wall of the carrier block in a gas-tight manner.

To achieve the forementioned object, it is provided according to the invention that the drive shaft forms the drive element traversing a housing wall of the carrier block in a gas-tight manner and is directly connected to the drive rod via a drive crank, the opening spring is also directly connected to the drive shaft via an opening crank, and the carrier block also carries the bearing of the closing shaft and forms the end support of the closing spring.

In the design according to the present invention, all drive elements of the stored-energy mechanism are placed and/or mounted on the carrier block, with the drive rod being directly connected to the drive shaft. No other components to support the closing and opening springs, for example, are needed for the operation of the mechanism. The mechanism can be pre-assembled and then only has to be inserted in a housing if needed. This housing will accommodate both the circuit breaker itself and the articulated-shaft mechanism, so that no separate housings are needed for the circuit breaker and the articulated-shaft mechanism. The carrier block itself carries, for example, a ceramic insulator, in the case of an open-air circuit breaker, or is flanged directly to the metal enclosure of an enclosed high-voltage switching device. Also in this case, the carrier block supports the entire mechanism. It can be designed as a single-piece casting, for example.

The arrangement of the closing, opening, and drive elements according to the invention further allows the stored-energy mechanism to be arranged in a particularly compact manner, for example, by also arranging the closing spring and the opening spring outside the insulating gas chamber and by arranging the closing spring and/or the opening spring in parallel to the longitudinal direction of the drive rod. This design also allows the closing energy of the closing spring to be transferred to the closing shaft via a rotating crank and from there to a crank of the drive shaft via a cam plate in the shortest possible way.

The carrier block used according to the invention can advantageously have a plate on its side facing the interrupter, which plate overlaps the contours of the other drive components in the directions perpendicular to the longitudinal direction of the drive rod, and forms a part of a drive housing. An integral component of the drive housing is thus connected to the carrier block in a simple manner. The plate can be placed on a carrier rack or set on the upper edge of a housing, for example. When the drive rod and a ceramic insulator mounted on it and surrounding it are at a right angle, the plate forms the upper part of the drive housing and protects the mechanism against rain, for example. This design also results in easy assembly, since the carrier block, including the closing and opening spring and the respective shafts, can be placed on the carrier rack in one piece ready to operate, and the wind-up mechanism with a tensioning motor, which engages with the closing shaft, for example, can also be previously mounted on the carrier block.

A further embodiment of the present invention provides that the other housing walls of the drive housing are attached to the carrier block.

The invention can also be configured so that on the side of the carrier block facing the interrupter unit, there is a flange attached, which serves for connecting the mechanism to an insulator or the metal enclosure of a switching device. This flange can be cast or screwed onto the carrier block, for example.

A stored-energy mechanism designed according to this invention can also be used for driving the other poles of a three-pole circuit breaker by coupling a connecting rod to the drive shaft of the stored-energy mechanism, which connecting rod is coupled to the drive shafts of the other circuit breaker poles.

Figure 1:
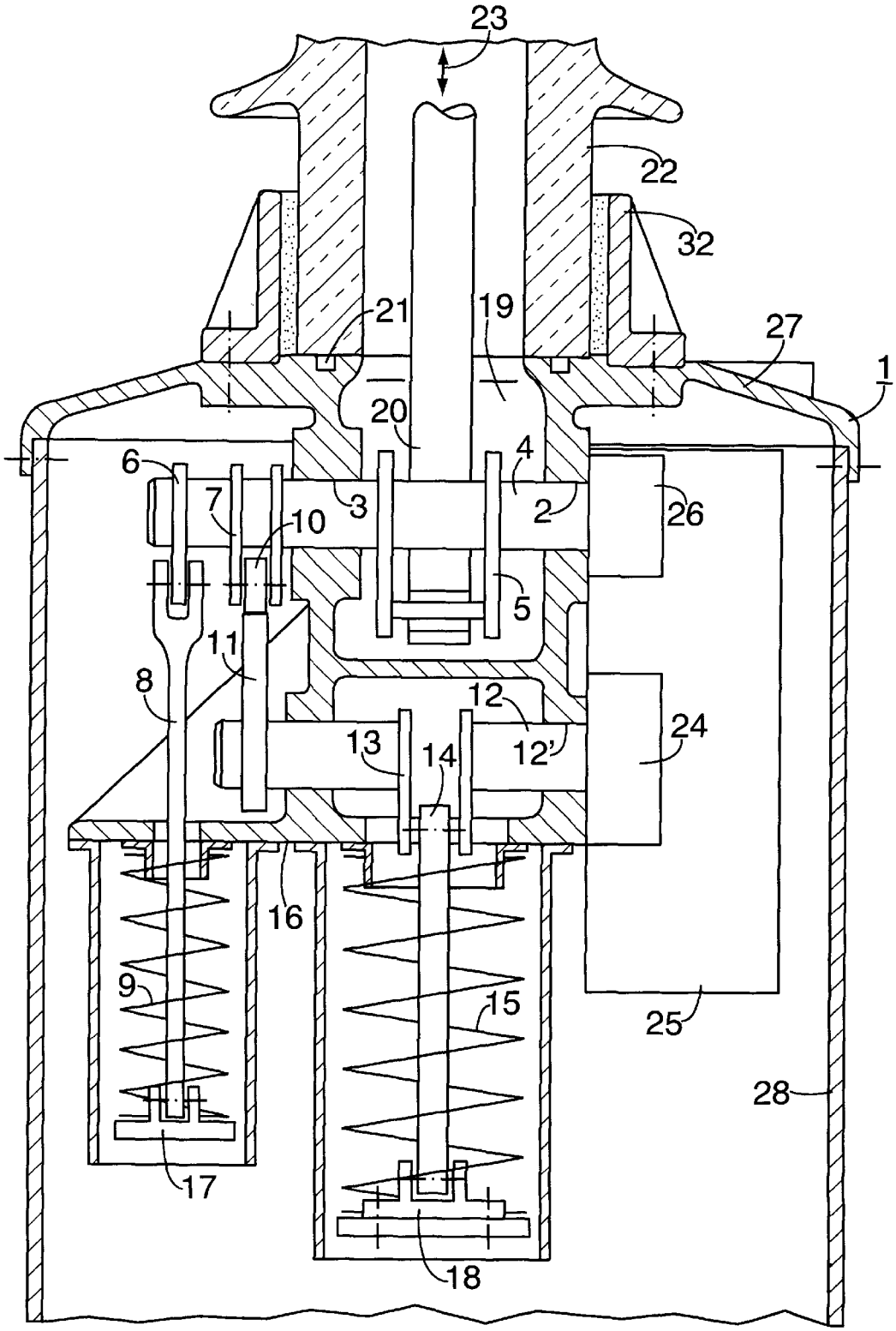
FIG. 1 shows a single-pole open-air high-voltage circuit breaker according to the present invention.

Carrier block 1 of the stored-energy mechanism illustrated in FIG. 1 is configured as a single-piece casting with bearings 2, 3 for driver shaft 4, with bearings 2, 3 optionally designed to be gas-tight. Drive shaft 4 traverses gas-tight bearings 2, 3 and the corresponding walls of carrier block 1. Drive crank 5 is arranged within carrier block 1, in insulating gas-filled area 19 of the high-voltage circuit breaker. An opening crank 6 and a closing crank 7 are attached to drive shaft 4 in the outer atmosphere area, outside the area filled with an insulating gas, for example, $SF_6$. A connecting rod 8 of opening spring 9 is connected to opening crank 6.

Closing crank 7 has a roller 10, which is driven by a cam plate 11. Cam plate 11 is in turn attached to a closing shaft 12, split in the longitudinal direction, which is supported by carrier block 1 at bearing 12' and has a rotating crank 13, connected to a connecting rod 14 of closing spring 15.

Both opening spring 9 and closing spring 15 are supported by bottom 16 of carrier block 1.

Connecting rods 8, 14 are connected, on their side facing away from drive shaft 4, with plates 17, 18, respectively, which support the corresponding springs.

Carrier block 1 has an inner chamber 19, where bearings 2, 3, as well as drive crank 5 and a part of drive shaft 4, are arranged, and which is sealed against the outer chamber in a gas-tight manner. Drive rod 20 penetrates this chamber 19 and is coupled to drive crank 5 attached to drive shaft 4.

An insulating body, for example, a ceramic body 22, is connected to carrier block 1 in a gas-tight manner, using, for example, a gasket 21. Drive rod 20 runs in said ceramic body up to the interrupter unit not illustrated here.

Drive rod 20 is moved in its longitudinal direction, indicated by arrow 23, by drive crank 5.

For this purpose, closing spring 15 must be previously tensioned and locked by a tensioning motor 24 illustrated schematically only, via closing shaft 12. For this purpose, a locking device 26 is also provided in housing 25, where tensioning motor 24 and the tensioning gear are arranged. Said locking device locks drive shaft 4. In this special case bearing 2 in carrier block 1 is also designed as a gas-tight rotating seal.

It can, however, also be provided that locking device 26 be arranged on the part of drive shaft 4 that is outside carrier block 1, on the side of closing crank 7 and crank 6.

Figure 2:
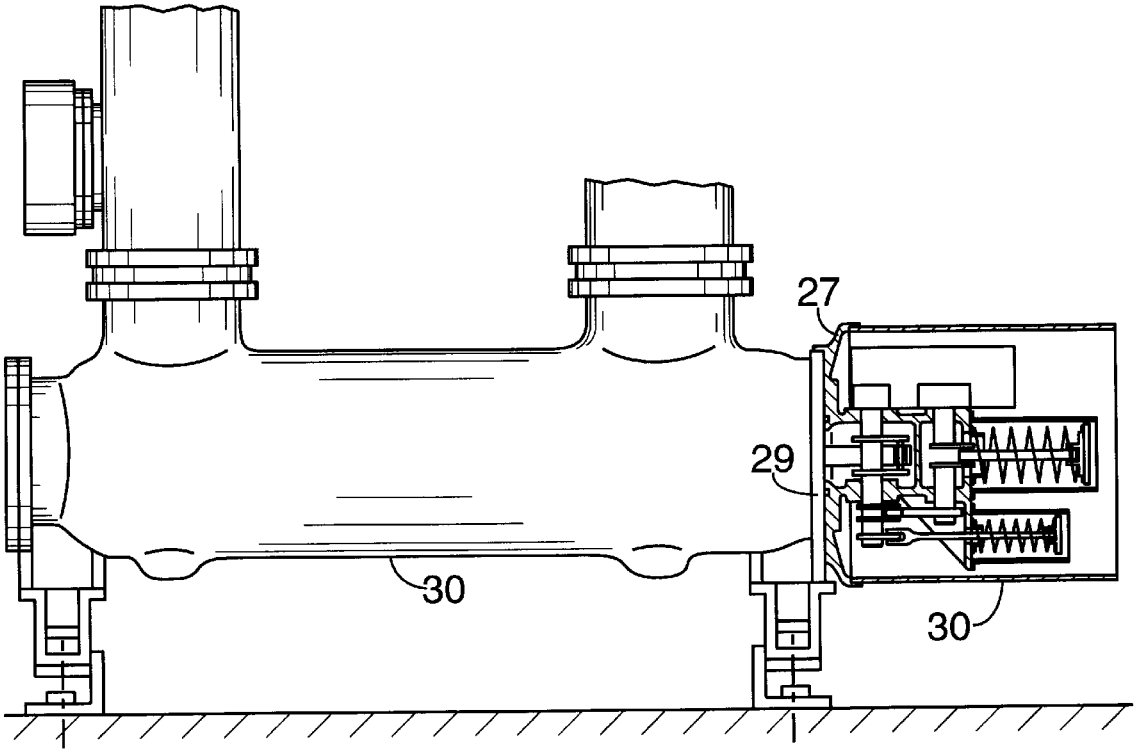
FIG. 2 shows a stored-energy mechanism according to the present invention coupled to a metal-enclosed high-voltage circuit breaker.

Carrier block 1 has, on its top end, a plate 27, which overlaps all parts of the stored-energy mechanism in the horizontal direction and on which a housing 28, resting on a base not shown, is mounted. A flange 32 is attached to plate 27 with a screw connection, and secures insulating body 22. Plate 27 can, as shown by FIG. 2, also be directly attached to a connecting flange 29 of a metallic enclosure 31 of an enclosed high-voltage circuit breaker. In this case, plate 27 supports housing 30.

Figure 3:
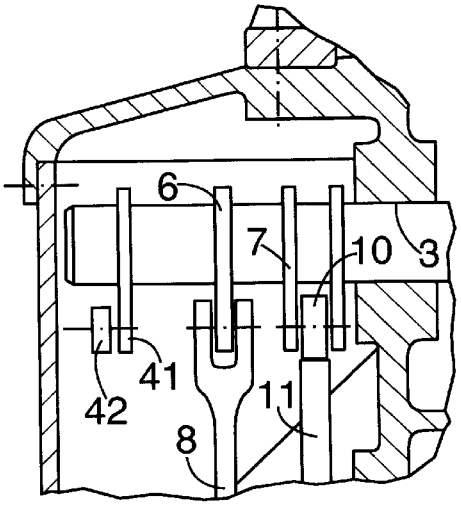
FIG. 3 shows a drive shaft for coupling to other circuit breaker poles in accordance with the present invention.

According to the sectional view of FIG. 3, another crank 41, connected to a rod 42, may be attached to drive shaft 4. Other circuit breaker poles, not illustrated in detail, can be coupled to drive shaft 4 using this rod, enabling a plurality of circuit breaker poles to be switched with a stored-energy mechanism according to FIG. 1.

What is claimed is:

1. A stored-energy mechanism for a high-voltage power circuit breaker, comprising:

a drive rod transmitting a drive motion to an interrupter unit by one of thrust and traction;

a drive crank;

a drive shaft coupled to the drive rod via the drive crank for driving the drive rod;

an opening spring connected to the drive shaft via an opening crank for actuating the drive shaft;

a closing spring actuating the drive shaft;

a closing crank:

a cam plate;

a closing shaft coupled to the closing spring and actuating the drive shaft via the closing crank and the cam plate; and a housing-type carrier block sealing an insulating gas chamber from an outer chamber, the drive shaft traversing a housing wall of the carrier block in a gas-tight manner, the carrier block supporting a bearing of the closing shaft and forming an end support for the opening spring and the closing spring.

2. The stored-energy mechanism according to claim 1, wherein the closing spring and the opening spring are arranged outside the insulating gas chamber.

3. The stored-energy mechanism according to claim 1, wherein the closing spring and the opening spring are helical springs.

4. The stored-energy mechanism according to claim 1, wherein one of the closing spring and the opening spring is arranged substantially in parallel to a longitudinal direction of the drive rod.

5. The stored-energy mechanism according to claim 1, where in a side of the housing-type carrier block facing the interrupter unit has a plate which overlaps the contours of at least one of the drive components at a right angle to a longitudinal direction of the drive rod, and forms a part of a drive housing.

6. The stored-energy mechanism according to claim 1, further comprising a drive housing containing at least one housing wall wherein at least one of the housing walls is attached to the housing-type carrier block.

7. The stored-energy mechanism according to claim 1, wherein a flange is attached to a side of the housing-type carrier block facing the interrupter unit, wherein the flange connects the plurality of drive elements with one of an insulator of a switching device and a metal enclosure of a switching device.

8. The stored-energy mechanism according to claim 1, wherein a drive shaft of a separate circuit breaker pole is connected to the drive shaft via a connecting rod.

* * * * *